US012778250B2

(12) United States Patent
Dufelmeier et al.

(10) Patent No.: US 12,778,250 B2
(45) Date of Patent: Nov. 3, 2026

(54) CASE FOR ACCEPTING DIFFERENT SIZES OF TABLETS

(71) Applicant: FELLOWES MOBILE LLC, Itasca, IL (US)

(72) Inventors: Jack Dufelmeier, Chicago, IL (US); Xiao Guang Wang, Schaumburg, IL (US)

(73) Assignee: Fellowes Mobile LLC, Itasca, IL (US)

( * ) Notice: Subject to any disclaimer, the term of this patent is extended or adjusted under 35 U.S.C. 154(b) by 240 days.

(21) Appl. No.: 18/479,687

(22) Filed: Oct. 2, 2023

(65) Prior Publication Data

US 2024/0215698 A1 Jul. 4, 2024

Related U.S. Application Data

(60) Provisional application No. 63/436,400, filed on Dec. 30, 2022.

(51) Int. Cl.
*A45C 11/00* (2006.01)
*A45C 13/26* (2006.01)

(52) U.S. Cl.
CPC ..... *A45C 11/00* (2013.01); *A45C 13/26* (2013.01); *A45C 11/002* (2025.01); *A45C 11/003* (2025.01)

(58) Field of Classification Search
CPC ..... A45C 11/00; A45C 13/26; A45C 11/002; A45C 11/003; H04B 1/3888; H04M 1/185; H04M 1/0264
USPC ..... 206/320, 521–594; 455/575.1
See application file for complete search history.

(56) References Cited

U.S. PATENT DOCUMENTS

| | | | | |
|---|---|---|---|---|
| 9,287,916 | B2 * | 3/2016 | Wicks | A45C 11/002 |
| 9,545,140 | B1 * | 1/2017 | Johnson | A45C 11/00 |
| 11,108,421 | B1 * | 8/2021 | Breault, Jr. | A45F 5/02 |
| 2013/0113348 | A1 * | 5/2013 | Holben | H05K 5/03 312/223.1 |
| 2016/0254836 | A1 * | 9/2016 | Alsberg | H04M 1/18 455/575.8 |
| 2020/0295795 | A1 * | 9/2020 | Fathollahi | H04B 1/3888 |
| 2024/0275421 | A1 * | 8/2024 | Storey | A45C 11/00 |

* cited by examiner

*Primary Examiner* — Chun Hoi Cheung
(74) *Attorney, Agent, or Firm* — Wood, Phillips, Katz, Clark & Mortimer

(57) ABSTRACT

Disclosed herein is a case for accepting portable electronic devices, such as tablets, of multiple sizes. The case includes a central well that may receive either the portable electronic directly, or a portable electronic device and a frame. The well is bordered by channels having a lip to an exterior face, the lip acting to retain the portable electronic device or frame and portable electronic device within the well. The material making up the frame is preferably of a higher durometer than the material making up the main body of the case.

14 Claims, 12 Drawing Sheets

Fig. 13
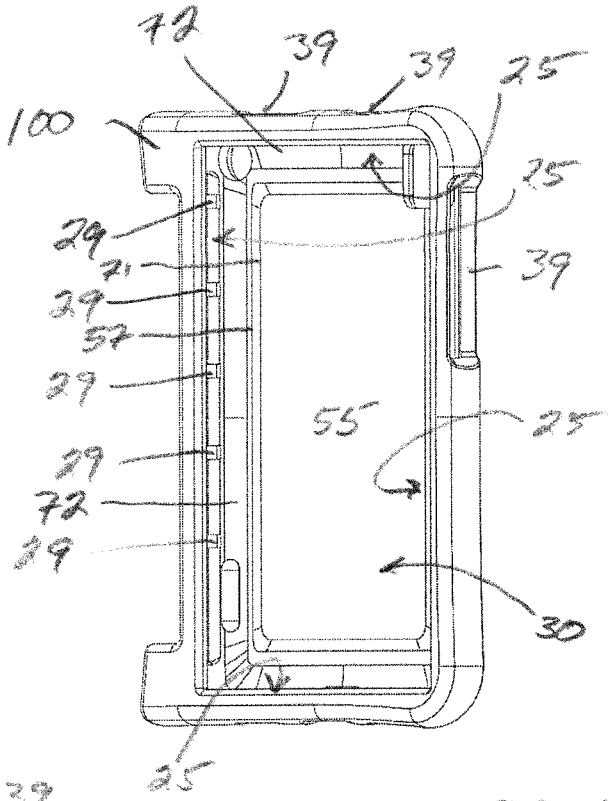
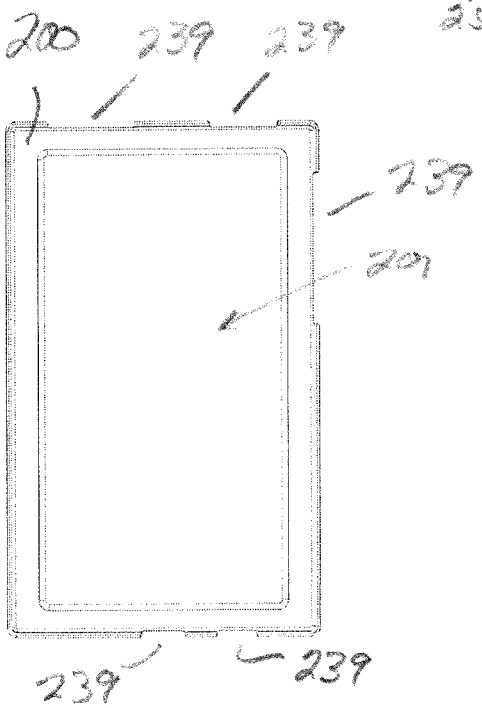
Fig. 14
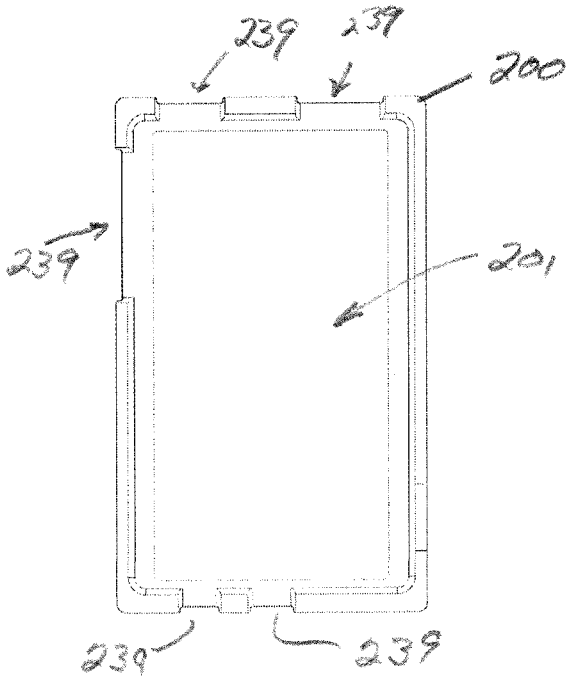
Fig. 15

Fig. 23
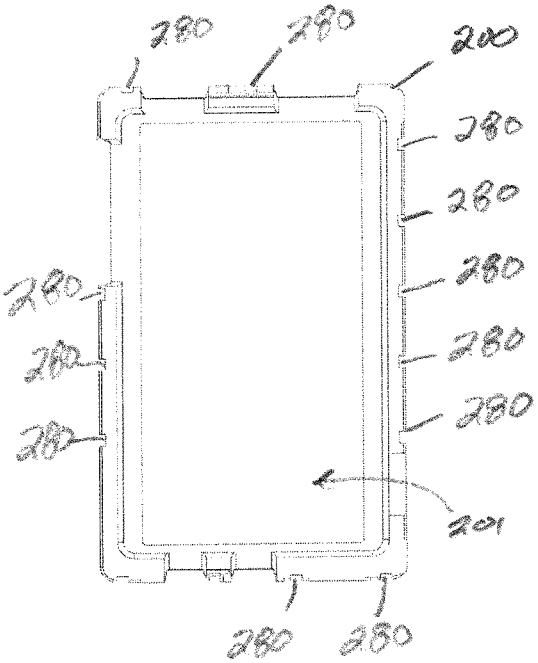
Fig. 24
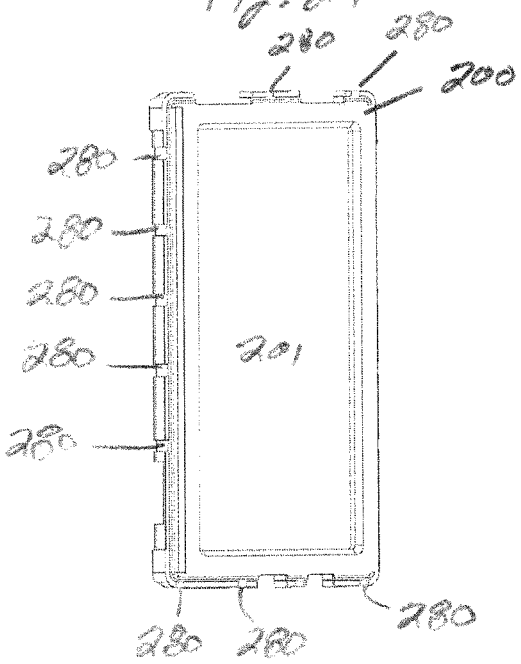
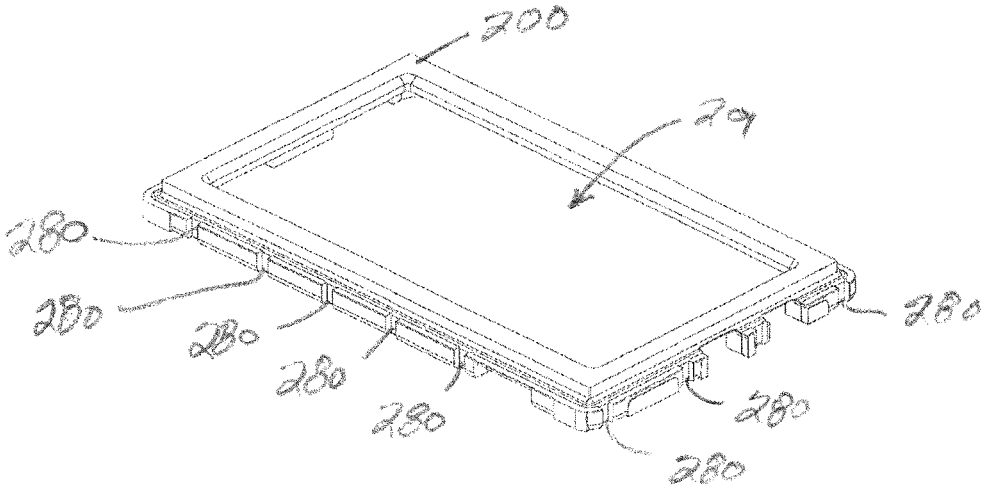
Fig. 25

Fig. 29
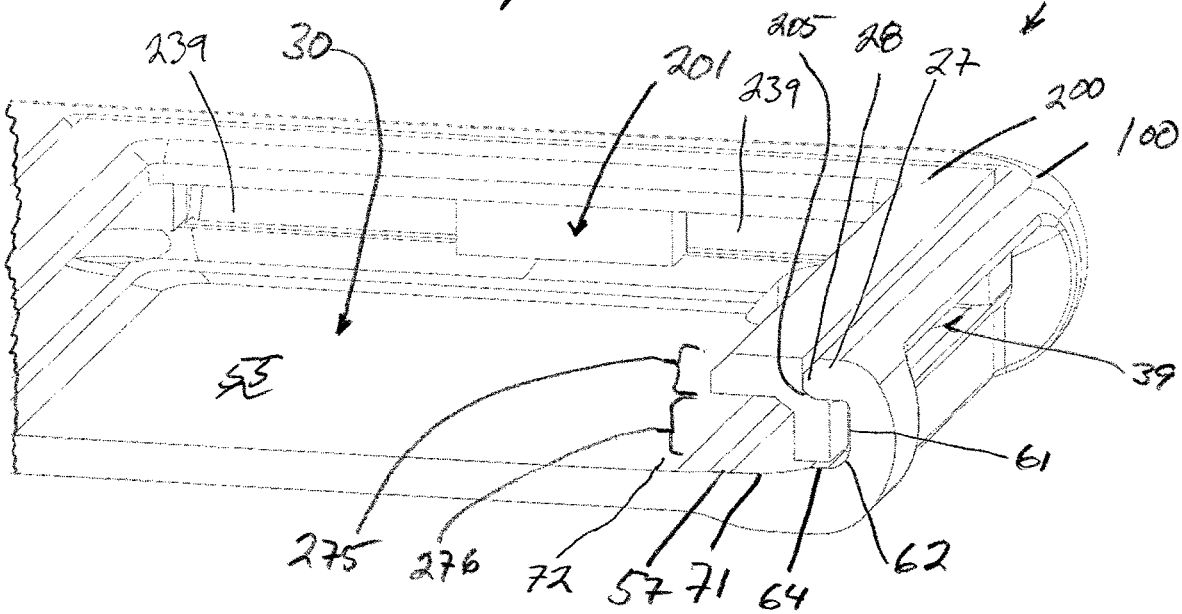
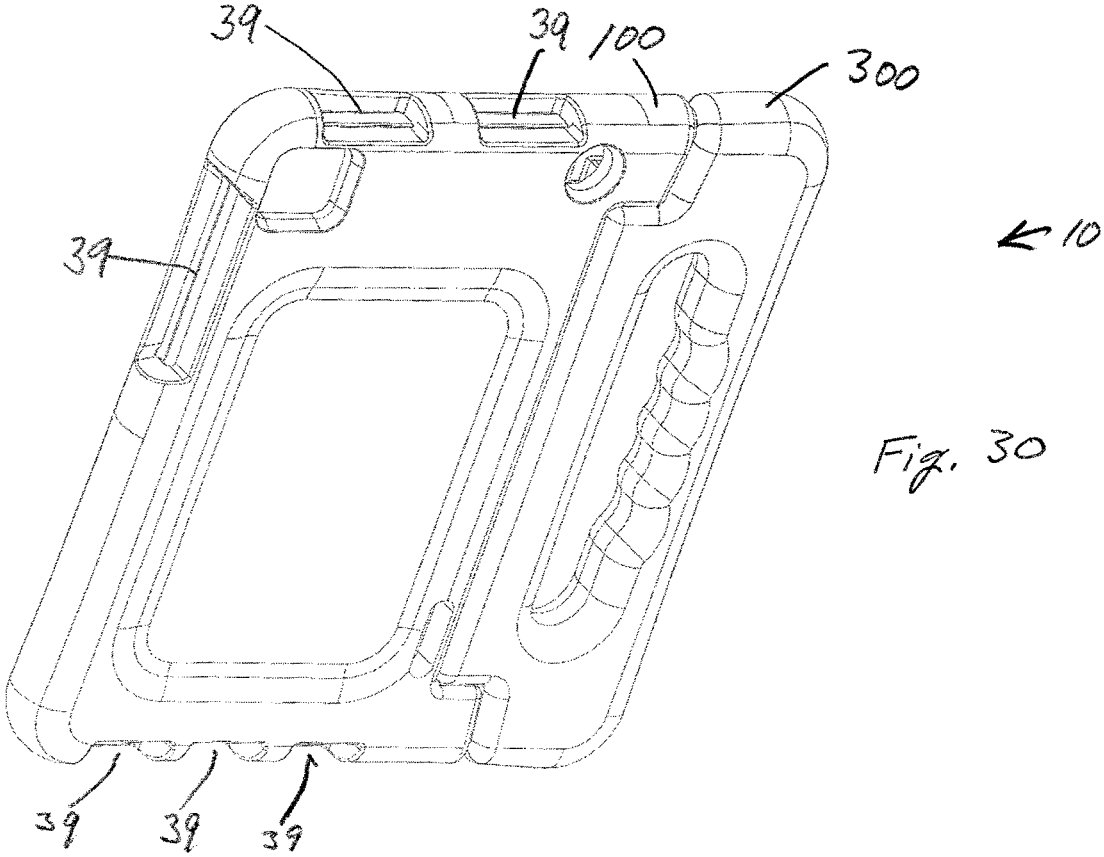
Fig. 30

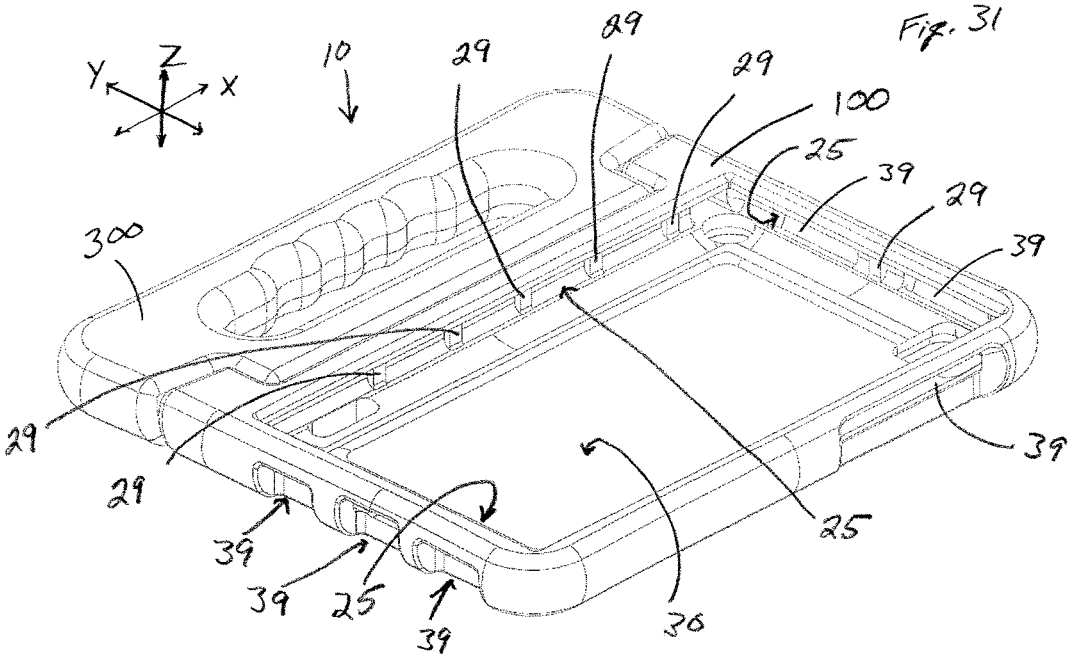
Fig. 31
Fig. 32
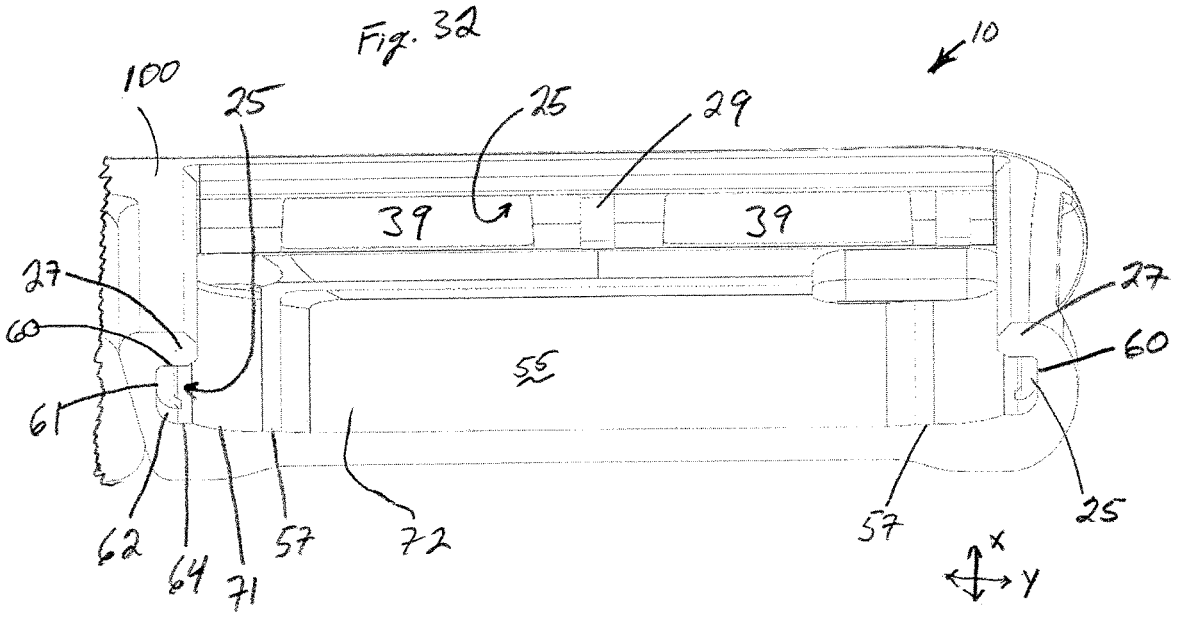

CASE FOR ACCEPTING DIFFERENT SIZES OF TABLETS

CROSS-REFERENCE TO RELATED APPLICATIONS

This is a non-provisional application claiming priority to U.S. Provisional Application No. 63/436,400, filed Dec. 30, 2022, which is incorporated herein by reference.

BACKGROUND OF THE INVENTION

Field of the Invention

This invention relates to the field of covers or cases for protecting portable electronic devices such as cell phones, tablets, and computers.

Background Art

Cases and covers for the protection of portable electronic devices are well known in the art. Such devices are typically designed to accommodate or fit a particular device model. For instance a case designed to fit an Apple iPhone 12 does not fit an Apple iphone 13. Similarly, a case that was designed to accommodate a Samsung tablet will not fit an iPad. Tablets also come is a variety of sizes as well, with common screen dimensions being 7 inches and 8 inches diagonally.

The cases of the prior art are generally constructed with narrow tolerances to form fit the electronic device. This form fit provides protection to the device, aligns openings on the case with ports of the device, and allows the case to be retained on the device with minimal obstruction of the display or screen.

Other cases have been designed with wide tolerances to accommodate a range of dimensions in an effort to be a universal case. These attempts have been less than optimal, as the electronic device moves around excessively in the case. These previous attempts also have not protected the screen or display sufficiently. In the example of a case made for children, the excessive movement of the tablet within the case and the lack of screen protection results in a heightened risk of damage to the device.

For cases designed for use by children, EVA foam cases are preferred. However the soft EVA foam, while provided good protection for the device when handled by children, does not offer sufficient stiffness to be easily configured to retain devices of varying sizes.

The invention disclosed herein permits the case to accommodate, secure, and protect a range of portable electronic devices.

SUMMARY OF THE INVENTION

The invention disclosed herein is a case or cover to accommodate portable electronic devices such as tablets and phones of various sizes. The case includes a main portion with a well to receive the body of the electronic device such as a tablet, and a bezel, also described as an insert or frame that fits into the well to surround the perimeter of the device and engage with a lip or flange on the perimeter of the well.

The components of the case may be made of EVA foam. The EVA foam's material compressibility allows a designer to create interference fits within the well of the case to sufficiently secure an array of tablets that differ in height, width, and thickness. The definition of "sufficiently" secure is somewhat subjective, but generally speaking, the invention desires to limit any X-Y-Z-axis movement to less than 1-2 mm in any direction—with most of the tablets currently on the market experiencing enough interference fit from the compressible material that they do not shift in the case nor get removed upon shaking or throwing, as might be experienced with a child's handling of the case and device secured therein.

To further allow for secure interference fit, the invention disclosed may include intentionally designed ribs along the top, bottom, and side walls of the well to provide the X-Y compressible interference retention for the greatest number of compatible tablet devices. Similarly, such ribs may be included on any well surface that is in contact with a surface of the device.

In some embodiments the backwall of the well contouring and front screen lip height and overhang are designed to provide the Z-axis compressible interference retention for the greatest number of compatible tablet devices. This design includes a dishing or contouring of the well. This may also be described as a shaped depression in interior surface of the back wall of the well. The flexibility and cushioning or compressibility of the EVA also allows the side channels of the case to accommodate varying thicknesses of devices or tablets.

In some embodiments, a frame or insert may be used to accommodate smaller sized devices. The removable EVA insert or frame that can be inserted into the well is designed to fit smaller tablets than the well of the case is designed for. For instance, the well of the case may be designed to fit a 9 inch tablet or an 8 inch tablet. The frame is designed to fit a 7 inch tablet. The frame or insert may include the ribs and be made of compressible EVA foam. In some embodiments, the frame may include a back wall that is dished or has a depression. However the frame may not include a back wall.

In some embodiments, the durometer of the foam of the insert or frame is significantly higher than the durometer of the case main body to ensure the frame is properly secured within the main EVA body and resists dislodgement. In some embodiments, the durometer of the material of the frame is 20 units greater than the durometer of the material of the main body. With the weight of a tablet device inside, the whole assembly of tablet, frame, and case main body must endure swinging, throwing, shaking without the frame or the device or insert becoming dislodged. The higher durometer of the material of the fame provides rigidity to the frame and aids in preventing the frame from disengaging from the frames fit with the lip of the main body.

The invention for a universal case disclosed herein provides competitive advantages over the prior art cases in its ability to better secure various sized tablets across multiple scales (7-8" and 9-10"), its ability to provide full product protection for any sized tablet (no exposed front screens without a protective material lip), and it's superior impact material of EVA foam that is preferred for a product made primarily for children and provides a higher drop rating regardless of the device.

In one form, the invention is directed to a case for protecting a portable electronic device. The case includes a main body and a frame. The main body has a well for receiving a portable electronic device. The well is defined by a plurality of perimeter walls and a back wall spanning therebetween. The well includes at least one perimeter channel. The frame is received in the perimeter channel. An exterior surface of the frame is level with an exterior surface of the main body.

In one form, the perimeter channel has a lip. The lip interferes with the frame to retain the frame in the well.

In one form, the lip has a terminal portion. The terminal portion engages a notch on the frame when the frame is in the well.

In one form, the terminal portion is spaced apart from a wall of the perimeter channel at a distance greater than an inward dimension of the notch. The frame is thereby spaced apart from a side wall of the perimeter channel.

In one form, the lip includes a bevel on a top surface of the lip. The bevel is adjacent to the frame when the frame is seated in the well.

In one form, the lip includes a bevel on a bottom surface of the lip.

In one form, the perimeter channel has ribs. The ribs extend away from the perimeter channel.

In one form, the back wall is dished.

In one form, the frame has a durometer that is at least 20 A higher than the durometer of the main body.

In one form, the invention is directed to a case to accommodate a plurality of sizes of portable electronic devices. The case includes a main body having a perimeter channel surrounding a well for receiving a portable electronic device. The frame has a durometer that is at least 20 A higher than the durometer of the perimeter channel of the main body.

In one form, the perimeter channel has a lip. The lip interferes with the frame to retain the frame in the well.

In one form, the lip has a terminal portion. The terminal portion engages a notch on the frame when the frame is in the well.

In one form, the terminal portion is spaced apart from a wall of the perimeter channel at a distance greater than an inward dimension of the notch. The frame is thereby spaced apart from a side wall of the perimeter channel.

In one form, the lip includes a bevel on a top surface of the lip. The bevel is adjacent to the frame when the frame is seated in the well.

In one form, the lip includes a bevel on a bottom surface of the lip.

In one form, the perimeter channel has ribs. The ribs extend away from the perimeter channel.

In one form, the back wall is dished.

In one form, the case retains a portable electronic device of a first size without the frame being seated in the well. The case retains a portable electronic device of a size different from the first size when the frame is seated in the well.

In one form, the invention is directed to a case to accommodate a portable electronic device. The case includes a main body and a frame. The main body has a well for receiving the portable electronic device within the case. The well is bounded by a plurality of perimeter channels spanned by a back wall. The perimeter channels have a lip. The lip includes a top surface defining a portion of the outer surface of the main body. The frame has a notch. The notch receives a terminal portion of the lip when the frame is in the well. The frame has an exterior surface level with the top surface of the lip. At least one of the perimeter channels includes a wall perpendicular to the top surface of the lip. The wall is spaced apart from the terminal portion of the lip at a distance greater than an inward dimension of the notch.

In one form, the durometer of the frame is 20 A greater than the durometer of the lip of the main body.

BRIEF DESCRIPTION OF THE DRAWINGS

FIG. 13 is a front side perspective view of the main body of the present invention.

FIG. 14 is a front plan view of the frame of the present invention.

FIG. 15 is a front plan view of the frame of the present invention.

FIG. 23 is a back plan view of a frame with notches of the present invention.

FIG. 24 is a perspective view of a frame with notches of the present invention.

FIG. 25 is a front left side perspective view of a frame with notches of the present invention.

FIG. 29 is a partial cross-sectional view of a main body and inserted frame of the present invention.

FIG. 30 is a back perspective view of the present invention.

FIG. 31 is a front perspective view of the case without a frame of the present invention.

FIG. 32 is a partial cross-sectional view of the main body of the present invention.

DETAILED DESCRIPTION OF THE PREFERRED EMBODIMENT

Figure 1:
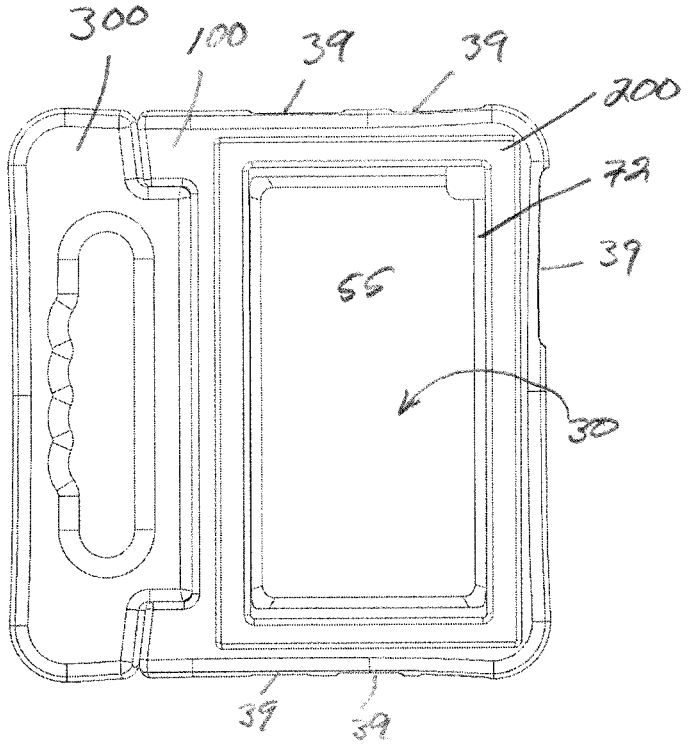
FIG. 1 is a front view of the assembled case of the present invention.
Figure 2:
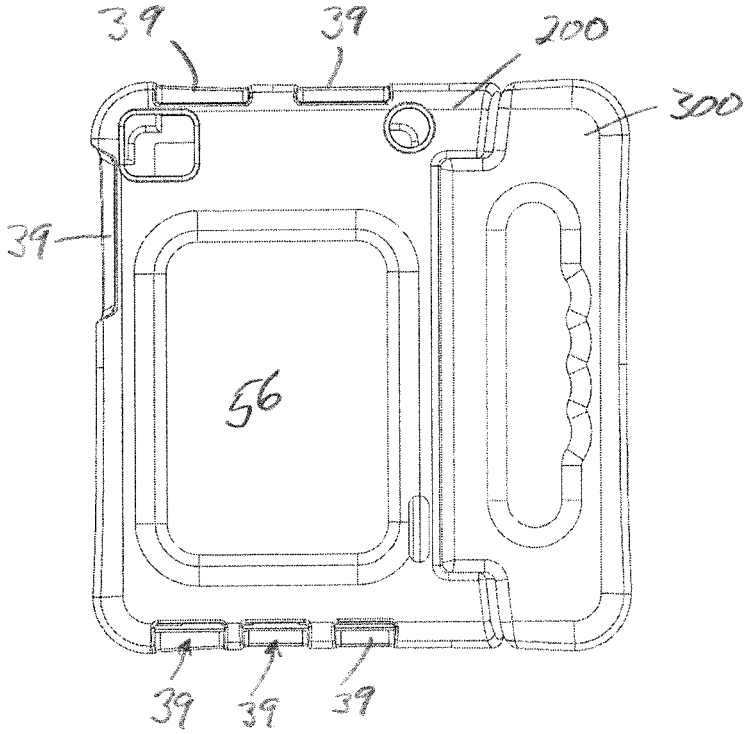
FIG. 2 is a back or rear view of the assembled case of the present invention.
Figure 3:
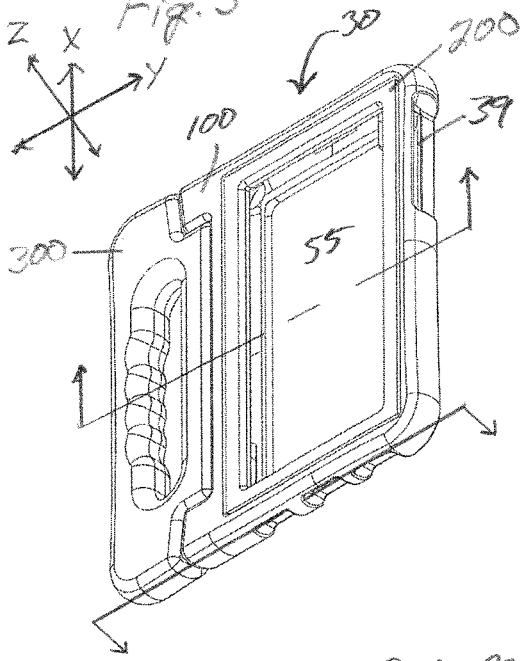
FIG. 3 is a front side perspective view of the assembled case of the present invention.
Figure 4:
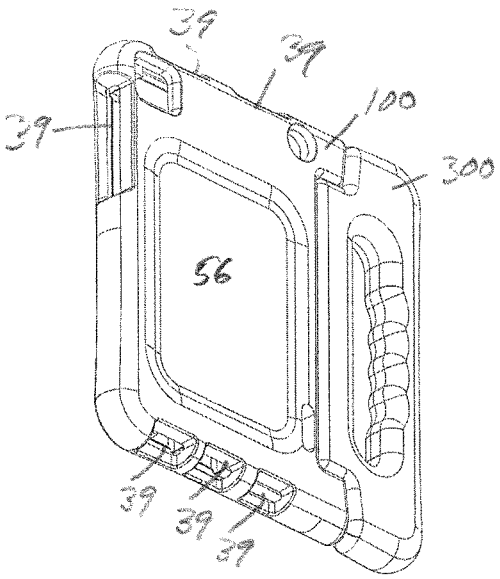
FIG. 4 is a back side perspective view of the assembled case of the present invention.
Figure 5:
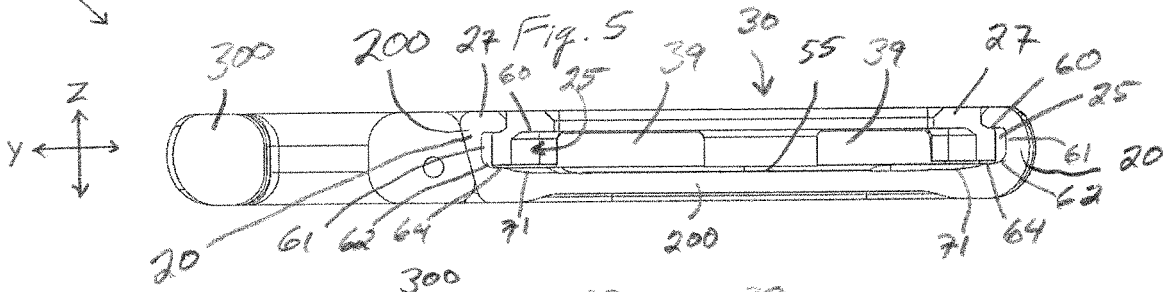
FIG. 5 is a side elevational cross-sectional view of FIG. 3.
Figure 6:
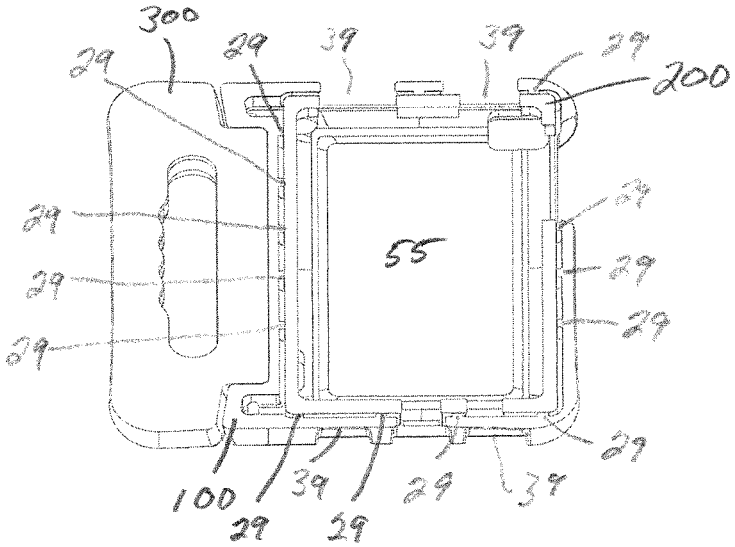
FIG. 6 is a front perspective cross-sectional view of FIG. 3.
Figure 7:
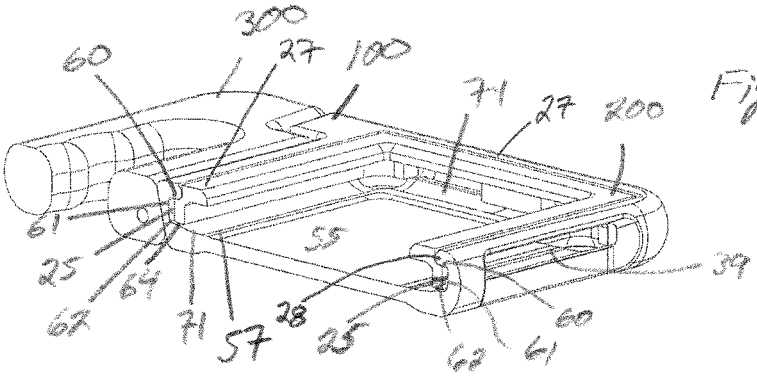
FIG. 7 is a front perspective cross sectional view of FIG. 3.
Figure 8:
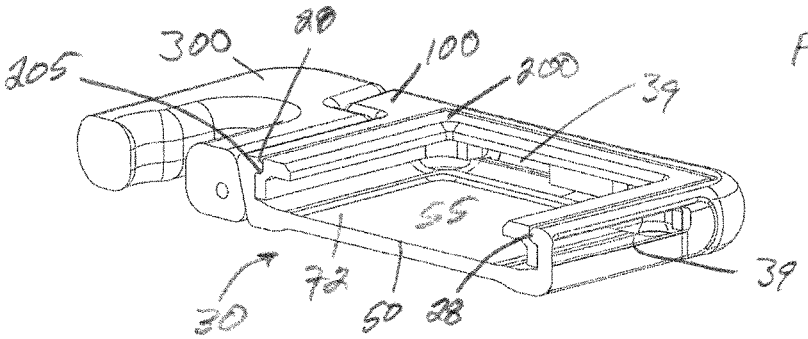
FIG. 8 is a front perspective cross-sectional view of an alternate embodiment where the lip of the case is smaller allowing the insert or frame to fit closer to the side wall of the case.
Figure 9:
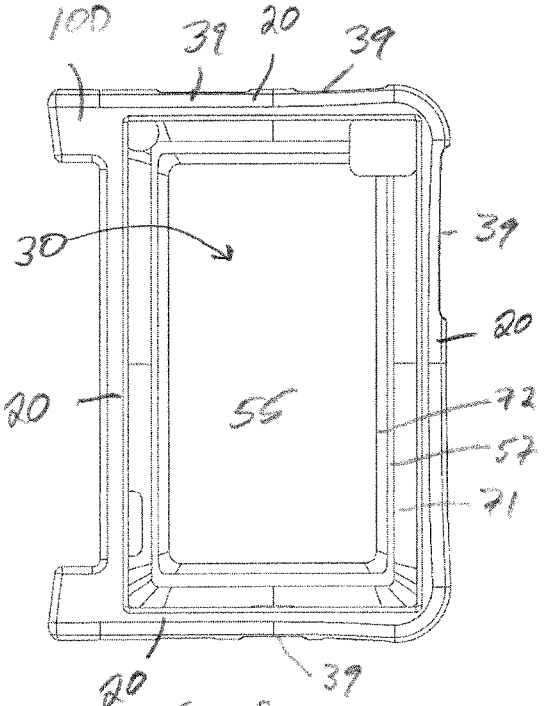
FIG. 9 is a front side perspective view of the main body of the present invention.
Figure 10:
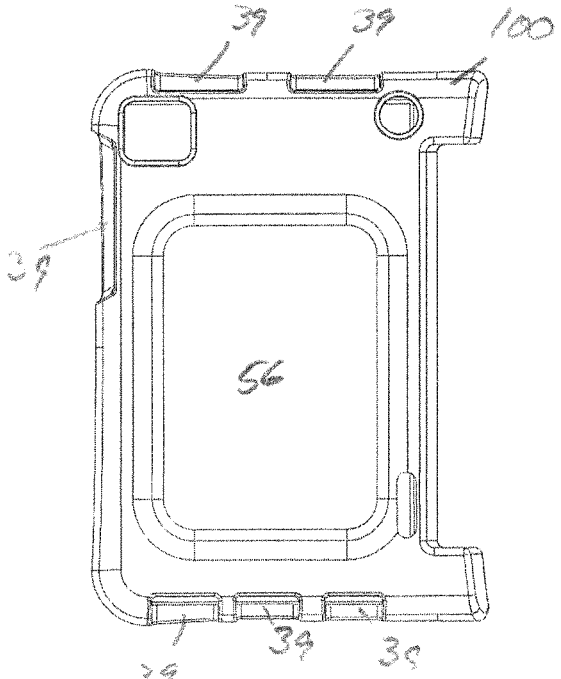
FIG. 10 is a back side perspective view of the main body of the present invention.
Figure 11:
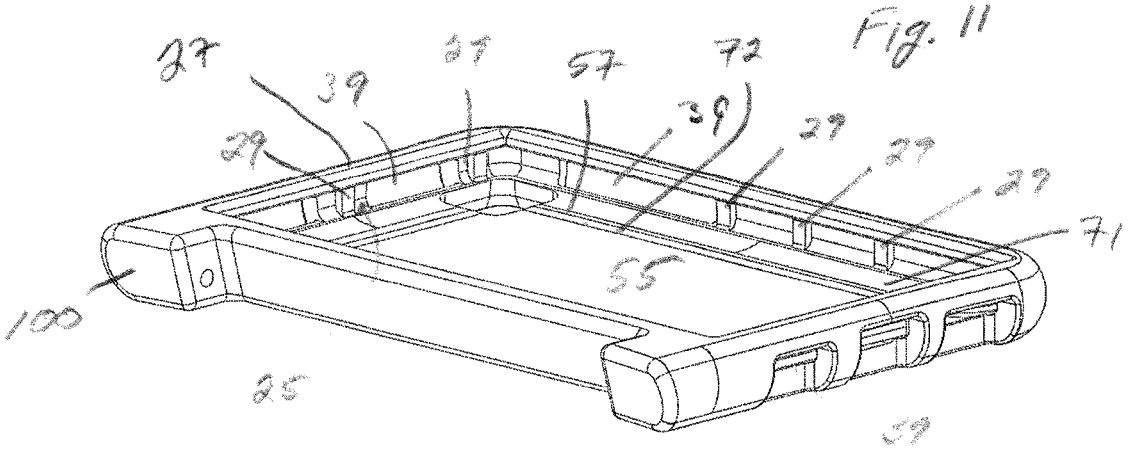
FIG. 11 is a front side perspective view of the main body of the present invention.
Figure 12:
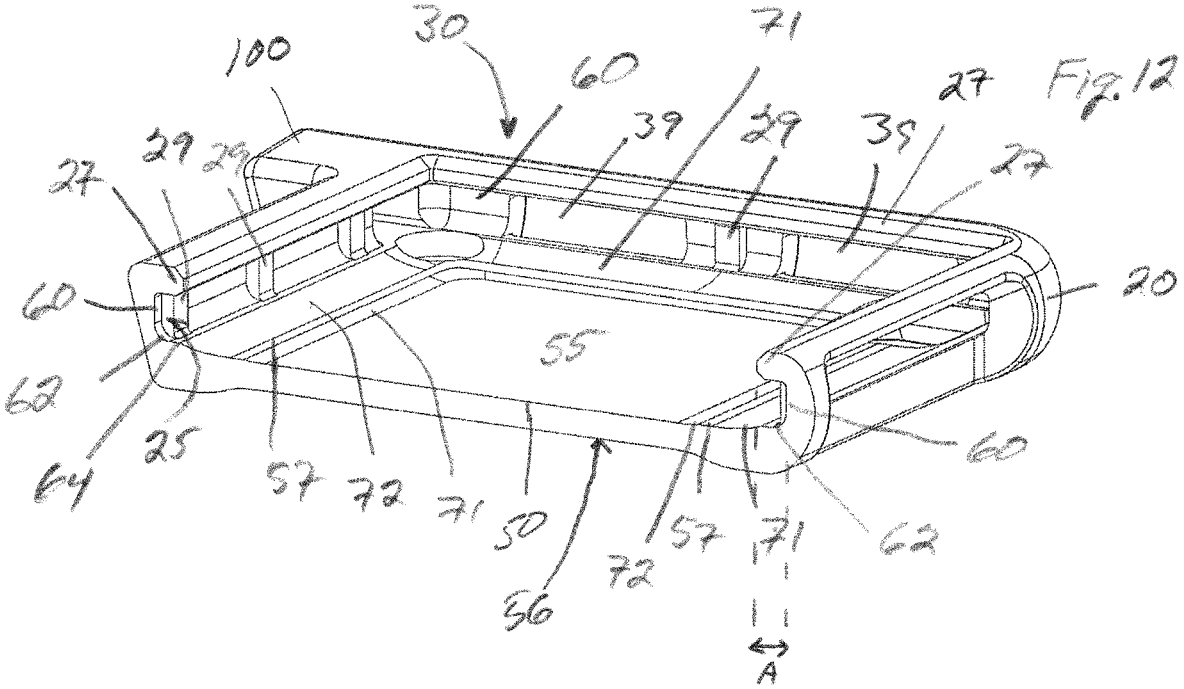
FIG. 12 is a front perspective cross-sectional view of the main body of the present invention.
Figure 16:
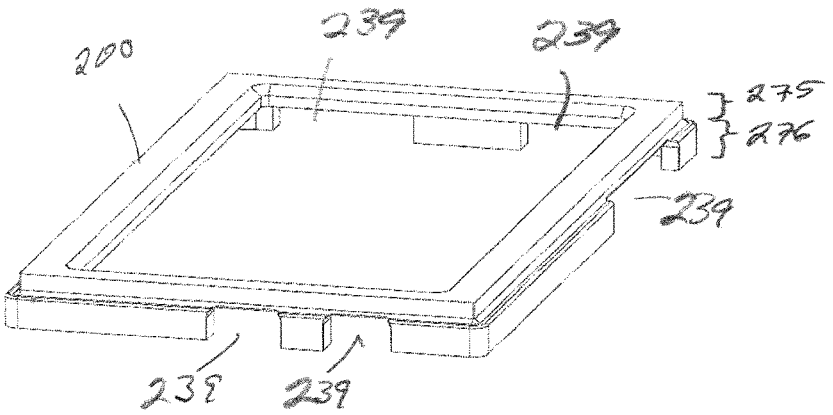
FIG. 16 is a front side perspective view of the frame of the present invention.
Figure 17:
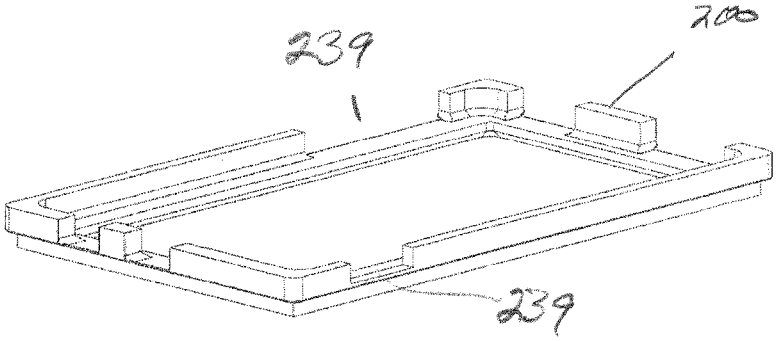
FIG. 17 is a rear side perspective view of the frame of the present invention.
Figure 18:
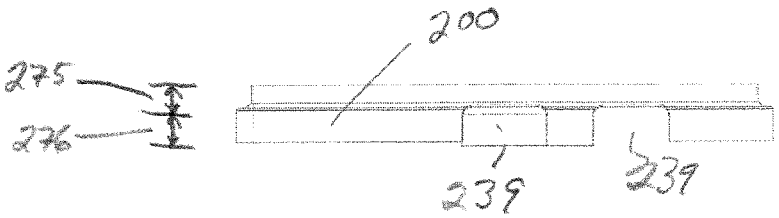
FIG. 18 is a front side perspective view of the assembled case of the present invention.
Figure 19:
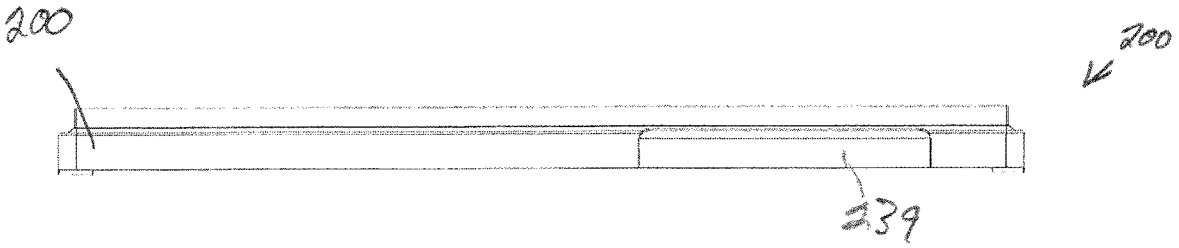
FIG. 19 is a bottom side elevational view of the frame of the present invention.
Figure 20:
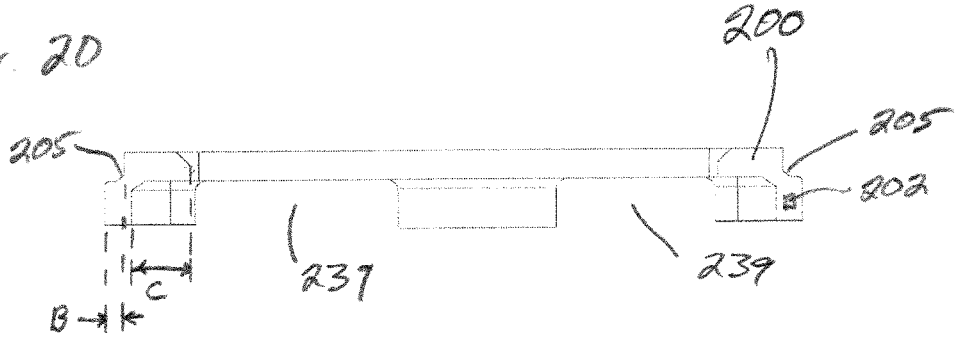
FIG. 20 is a left side cross-section elevational view of the frame of the present invention.

With reference to the drawings, the cover or case 10 incudes a main body 100, a frame 200, and a handle 300. The frame 200 fits into the main body 100. The handle 300 is hingedly attached to the main body.

In some embodiments, the main body 100 or the frame 200 is made of EVA of other suitable material for cases to protect a portable electronic device. In some embodiments, the frame 200 has a durometer that is greater than the durometer of the main body 100. In the most preferred embodiments, the durometer of the main body 100 is at least 20 greater than the durometer of the frame 200. In some embodiments, the durometer of the main body 100 is in the range of 40 to 60 A and the durometer of the frame 200 is in the range of 60 to 80 A.

Figure 21:
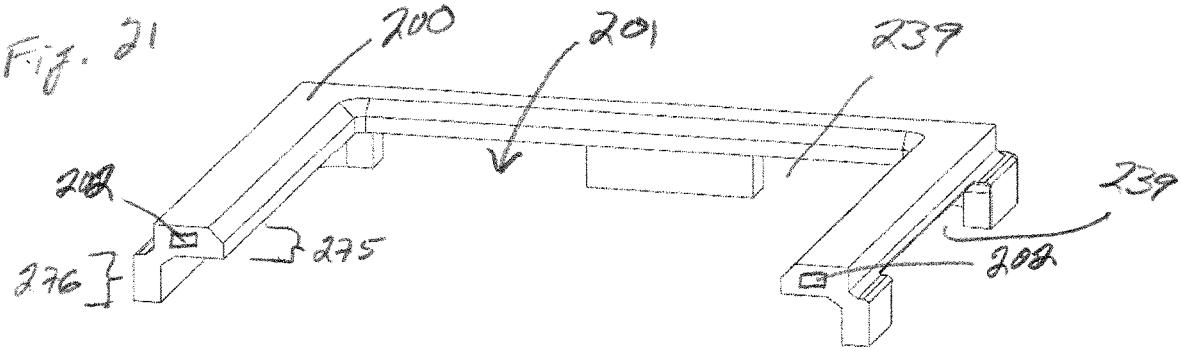
FIG. 21 is a front left side perspective cross-sectional view of the frame of the present invention.
Figure 22:
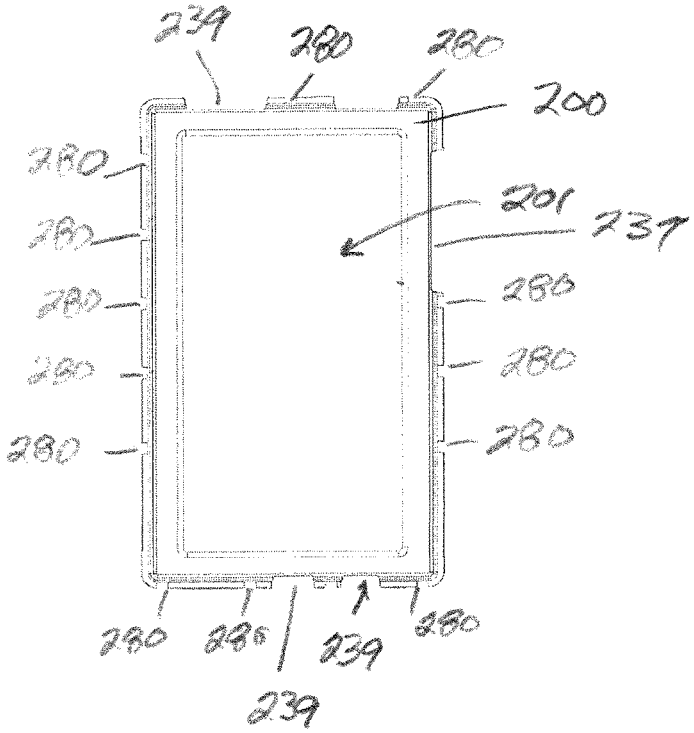
FIG. 22 is a front plan view of a frame with notches of the present invention.

In some embodiments, the frame 200 has a stiffening member 202 within or on the EVA. In FIG. 21 the stiffening member 202 is shown within the EVA. The stiffening member 202 is located about the central aperture 201 of the frame 200. In some embodiments, the stiffening member 202 is preferably located about the upper portion 275 of the frame 200. In other embodiments, the stiffening member is located in the lower portion 276 of the frame 200. The lower portion 276 of the frame is the portion that is in interfering fit with the lip 27, such that the frame 200 is prevented from moving in the Z direction by the lip 27. The lower portion 276 of the frame may be called a flange. The upper portion 275 overhangs the lower portion 276 a distance C to create an interference lip to hold a tablet in the well 30 of the case when the frame 200 is in the main body 100.

Figure 26:
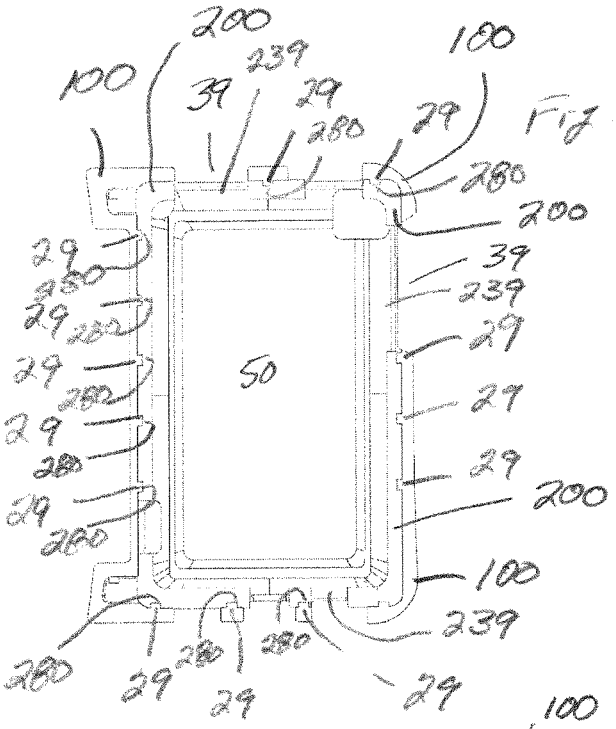
FIG. 26 is a front cross-sectional view of an alternate embodiment of the main body of the present invention.
Figure 27:
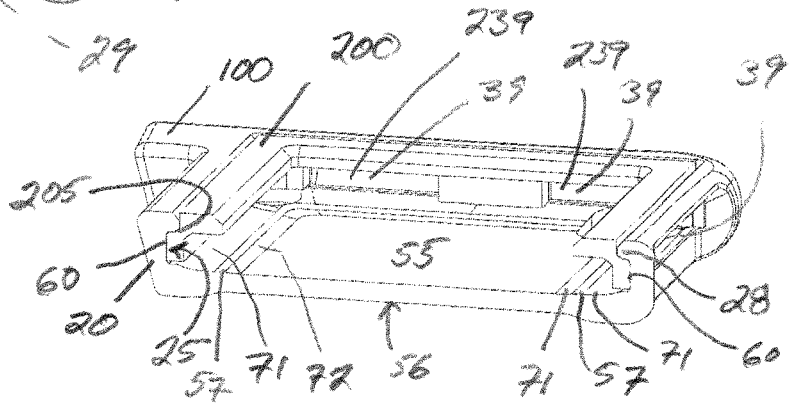
FIG. 27 is a left side cross-sectional view of a main body and inserted frame of the present invention.
Figure 28:
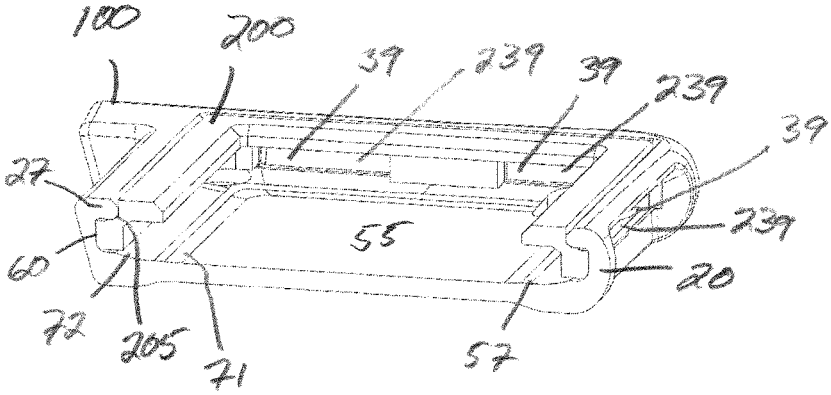
FIG. 28 is a left side cross-sectional view of a main body and inserted frame of the present invention.
Figure 33:
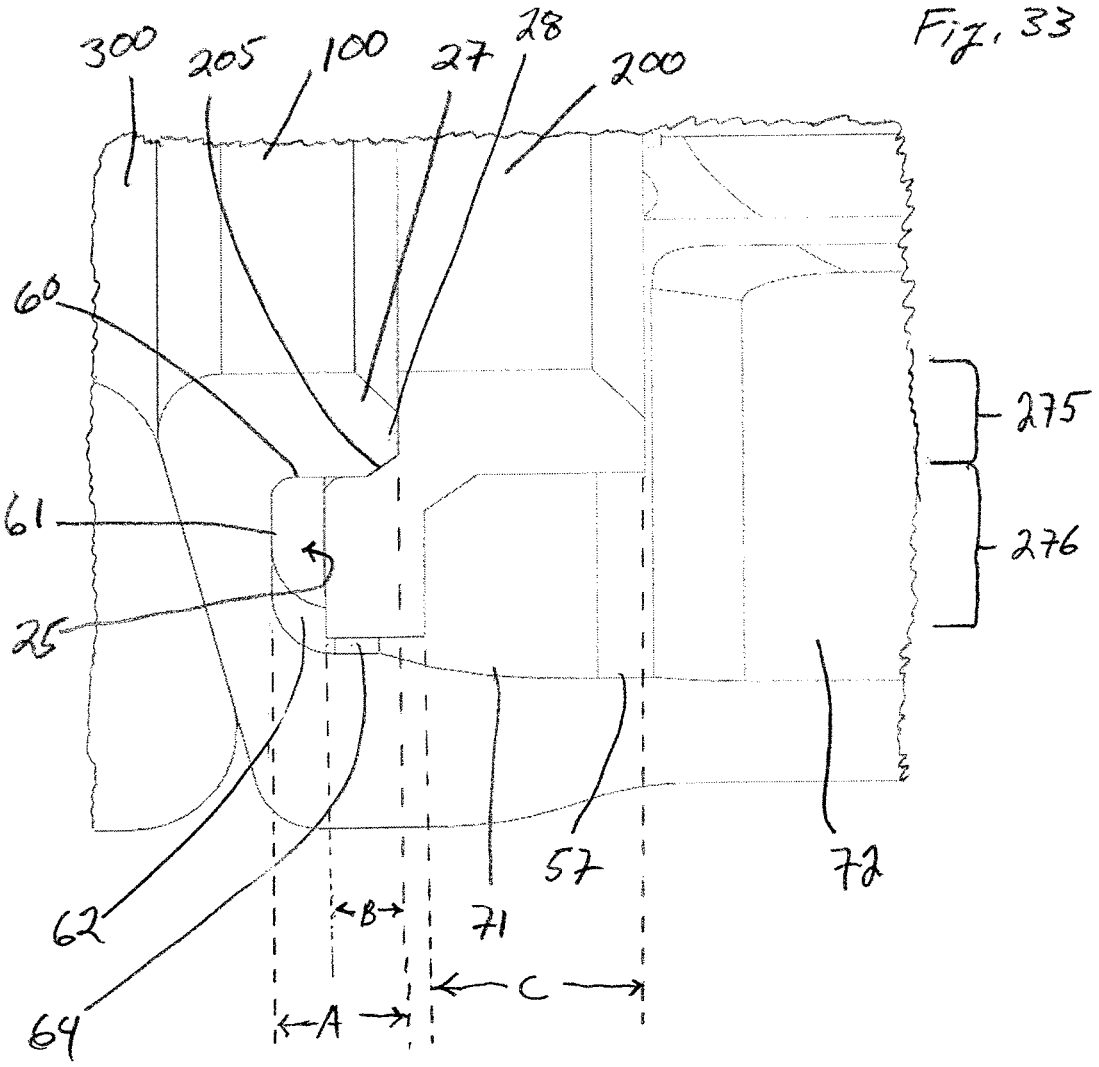
FIG. 33 is a partial cross-sectional view of the main body and inserted frame of the present invention.

In some embodiments, the lower portion includes a plurality of notches 280. The notches 280 preferably run in the z or vertical direction and are located on a perimeter surface of the frame 200 that opposes the side wall 61 of a perimeter channel 25. More preferably, the notches 280 oppose ribs 29 in the perimeter channel 25 in some embodiments, as shown in FIGS. 26 and 27.

The main body 100 includes a plurality of perimeter walls 20 and a back wall 50 joining the perimeter walls 20 to form a well 30 to receive the portable electronic device or the frame 200. The well 30 is generally rectangular in its perimeter shape, however the shape may be varied to accommodate different devices. The perimeter of the well 30 may be bounded by perimeter channels 25. The perimeter channels may be present as a continuous channel about the entire perimeter, or the channels may be discontinuous. The perimeter channels 25 may transition directions such as the transition from the x direction to the y direction at the corner of a rectangle. The discontinuous channels may have discontinuity in one of the walls or surfaces that define the channel. In some embodiments, the back wall of a perimeter channel 25 may include an aperture 39 or plurality of apertures. The apertures 39 may be used to access features of the portable electronic device secured or seated in the well 30. In some embodiments, the frame 200 may include corresponding, registered, or opposing apertures 239. One skilled in the art will recognize that the frame 200 need not be positioned in all instances so that all apertures 39 and 239 align or are registered.

The frame 200 may include a plurality of apertures 39 to accommodate different devices. A first side of the frame may include apertures 39 for a first device, while a second side of the frame may include apertures 39 for a second device. The selection of which apertures may be used can be controlled by rotating the frame 200 180 degrees about the Z axis. Similarly, a second and third side may also include apertures 39 for different devices, the apertures used controlled by the orientation of the frame 200 in the main body 100.

In some embodiments, the perimeter channels 25 include a lip 27. The lip may include a lip wall 60 which forms part of a perimeter channel 25.

In some embodiments, the lip 27 engages or interferes with the frame 200 when the frame is inserted in the well 30, as noted over distance B. The interference retains the frame 200 in the well 30 and in the main body 100 and resists dislodgment of the frame 200 in the z direction. Similarly, the lip engages or interferes with the body of a properly sized portable electronic device when such a device is inserted into the well 30 without the frame 200.

In some embodiments, the lip 27 may include a terminal portion 28 that engages with a notch 205 in a portion of the frame 200. In some embodiments, the notch 205 may extend downward and inward from the nominal exterior surface of the frame 200. The downward dimension of the notch is approximately that of the thickness of the lip, thus allowing the top surface of the frame 200 to be level with the top surface of the main body 100.

In some embodiments, the inward dimension in the x or y direction of the notch 205 is less than the overhang dimension A of the lip 27. One skilled in the art will recognize that the inward direction may be x or y depending upon which side of the case the lip 27 is on. The overhang dimension A of the lip 27 is the distance from the interior side wall of the channel 25 to the terminal end 28 of the lip 27. Thus in such an embodiment, the seated or installed frame 200 is spaced apart from the side wall of the perimeter channel 25. The lip 27 resists movement or displacement of the frame 200 in the upward or Z direction. In some embodiments, the terminal end 28 of the lip 27 includes a taper or bevel. In some embodiments, the taper or bevel is on the top surface of the lip 27. In some embodiments, the taper or bevel is on the bottom surface of the lip. In some embodiments, the taper or bevel is present on both the top and bottom surfaces of the lip 27. In some embodiments, the taper or bevel is at a 45 degree angle.

In some embodiments, the interior of the perimeter channel includes a lip wall 60, a side wall 61, and a bottom wall 62. The transition from the side wall 61 to the bottom wall 62 may be angular and meet at a vertex. In some embodiments, the transition from the side wall 61 to the bottom wall 62 is curved or an arc. In some embodiments, the curve or arc may be considered the bottom wall 62.

In some embodiments, the bottom wall 62 includes a flat portion 64. The flat portion 64 may support the frame 200 when the frame is seated in the perimeter channels 25. In other embodiments, the bottom wall 62 may include a surface shape which is complementary to the surface shape of the opposing portion of the frame 200.

In some embodiments, at least a portion of the interior surface 55 of the back wall 50 may be contoured. The contour allows the case main body 100 to accommodate different sized tablets, including tablets having different thicknesses or tablets that have in inconsistent thickness. In some embodiments, the contour is a dished or concave surface such that the surface varies in the z direction. The contour may extend from the flat or complementary portion of the bottom wall 62 of a perimeter channel 25, or it may extend from the side wall 61. In such an embodiment, the opposing frame surface may have a complementary contour for the portion that is in contact with the back wall 50.

In some embodiments, the contour of the interior surface 55 of the back wall 50 may not be constant. In such an embodiment, the contour may change across its length or width in the x or y direction. In some embodiments, the interior surface has a first portion with a first contour 71, and a second portion with a second contour 72. In the most preferred embodiment, the second contour is steeper than the first contour. Being more concave may mean that the rate of change in the z direction is greater per unit of the X or Y direction, such as dz/dx or dz/dy as the case may be. In the most preferred embodiment, the interior surface has the greatest depression in the z direction near the center of the well 30.

In some embodiments, the area of transition between the first contour 71 and the second contour 72 may include a ridge 57. The ridge 57 may contact be back of a portable electronic device seated or secured in the well 30 of the main body 100 of the case. In other embodiments, the ridge 57 is not a ridge in the sense that it is a bump or lies above the surface, but rather it is a transition in pitch between the first contour 71 and the second contour 72.

In some embodiments, the contour of the interior surface 55 of the back wall 50 is a depressed flat portion. The depressed flat portion transitions from the perimeter flat portion with an arced or curved surface. In other embodiments, the transition to the depressed flat portion may be angular.

In some embodiments, the exterior surface 56 of the back wall 50 of the main body 100 may be concave or contoured. As with the interior surface, the exterior surface may include similar features.

In some embodiments, the perimeter channel 25 may include ribs 29. The ribs 29 may extend away from the inner surface of the side wall 61 of the perimeter channel 25. The ribs preferably run in the z direction, although they may also run in the x, y, or any direction. Some of the ribs 29 may extend to contact the frame 200 when the frame is in the well 30 of the case. In some embodiments, the ribs 29 are spaced at intervals. When the frame 200 is not in the well, as may be the case for a larger tablet, the ribs 29 may be in contact with the sides of the inserted tablet. The ribs 29 may compress to accommodate different sized tablets.

The foregoing disclosure of specific embodiments is intended to be illustrative of the broad concepts comprehended by the invention.

The invention claimed is:

1. A case for protecting a portable electronic device, the case including a single-piece main body and a frame, the main body including a well for receiving a portable electronic device, the well defined by a plurality of perimeter walls and a back wall spanning therebetween, the well including at least one perimeter channel, the frame being received in the perimeter channel, an exterior surface of the frame being level with an exterior surface of the main body, wherein the perimeter channel includes a lip, the lip interfering with the frame to retain the frame in the well, wherein the lip includes a terminal portion, the terminal portion engaging a notch on the frame when the frame is in the well, and wherein the terminal portion is spaced apart from a wall of the perimeter channel at a distance greater than an inward dimension of the notch, the frame thereby spaced apart from a side wall of the perimeter channel.

2. The case of claim 1, wherein the lip includes a bevel on a top surface of the lip, the bevel adjacent to the frame when the frame is seated in the well.

3. The case of claim 1, wherein the lip includes a bevel on a bottom surface of the lip.

4. The case of claim 1, wherein the perimeter channel includes ribs, the ribs extending away from the perimeter channel.

5. The case of claim 1, wherein the back wall is dished.

6. The case of claim 1, wherein the frame has a durometer that is at least 20 A higher than the durometer of the main body.

7. A case to accommodate a plurality of sizes of portable electronic devices, the case including a main body having a perimeter channel surrounding a well for receiving a portable electronic device, and a removable frame where at least a portion of the frame is received in the perimeter channel when the frame is seated in the well, the frame having a durometer that is at least 20 A higher than the durometer of the perimeter channel of the main body, wherein the perimeter channel includes a lip, the lip interfering with the frame to retain the frame in the well, wherein the lip includes a terminal portion, the terminal portion engaging a notch on the frame when the frame is in the well, wherein the terminal portion is spaced apart from a wall of the perimeter channel at a distance greater than an inward dimension of the notch, the frame thereby spaced apart from a side wall of the perimeter channel.

8. The case of claim 7, wherein the lip includes a bevel on a top surface of the lip, the bevel adjacent to the frame when the frame is seated in the well.

9. The case of claim 7, wherein the lip includes a bevel on a bottom surface of the lip.

10. The case of claim 7, wherein the perimeter channel includes ribs, the ribs extending away from the perimeter channel.

11. The case of claim 7, wherein the back wall is dished.

12. The case of claim 7, wherein the case retains a portable electronic device of a first size without the frame being seated in the well, and retains a portable electronic device of a size different from the first size when the frame is seated in the well.

13. A case to accommodate a portable electronic device, the case including a main body and a frame, the main body including a well for receiving the portable electronic device within the case, the well bounded by a plurality of perimeter channels spanned by a back wall, the perimeter channels including a lip, the lip including a top surface defining a portion of the outer surface of the main body, the frame including a notch, the notch receiving a terminal portion of the lip when the frame is in the well, the frame including an exterior surface level with the top surface of the lip, at least one of the perimeter channels including a wall perpendicular to the top surface of the lip, the wall spaced apart from the terminal portion of the lip at a distance greater than an inward dimension of the notch.

14. The case of claim 13, wherein the durometer of the frame is 20 A greater than the durometer of the lip of the main body.

* * * * *